US008786457B2

(12) United States Patent
Kwan et al.

(10) Patent No.: US 8,786,457 B2
(45) Date of Patent: Jul. 22, 2014

(54) IDENTIFICATION DISPLAY METHOD AND SYSTEM

(75) Inventors: Derek Kwan, Ontario (CA); Angela Yuen Ching Lee, New Market (CA)

(73) Assignee: International Business Machines Corporation, New Armonk, NY (US)

( * ) Notice: Subject to any disclaimer, the term of this patent is extended or adjusted under 35 U.S.C. 154(b) by 295 days.

(21) Appl. No.: 13/080,805

(22) Filed: Apr. 6, 2011

(65) Prior Publication Data

US 2012/0256757 A1 Oct. 11, 2012

(51) Int. Cl.
*G08B 3/00* (2006.01)

(52) U.S. Cl.
USPC ..... 340/691.1; 340/815.45; 345/46; 345/690

(58) Field of Classification Search
CPC ..... G09F 9/302; G09F 9/33; G09G 3/16; G09G 2320/08; G09G 2320/0626
USPC ..... 340/691.1, 815.4, 815.45; 315/152, 315/250, 312; 345/46, 690
See application file for complete search history.

(56) References Cited

U.S. PATENT DOCUMENTS

| | | | | |
|---|---|---|---|---|
| 4,837,565 | A * | 6/1989 | White | 345/46 |
| 4,905,232 | A * | 2/1990 | Newman | 370/412 |
| 7,633,463 | B2 | 12/2009 | Negru | |
| 2004/0171915 | A1 * | 9/2004 | Glukhovsky et al. | 600/160 |
| 2006/0244622 | A1 | 11/2006 | Wray | |
| 2010/0148676 | A1 | 6/2010 | Simmers | |

* cited by examiner

*Primary Examiner* — Steven Lim
*Assistant Examiner* — Hongmin Fan
(74) *Attorney, Agent, or Firm* — Schmeiser, Olsen & Watts; John Pivnichny

(57) ABSTRACT

A message presentation method and system is disclosed. The method includes receiving by a computer processor of an electrical device, data associated with a function of the electrical device. The electrical device comprises light emitting devices. The computer processor generates an identification code identifying the function, a first bit signal associated with a first bit of the identification code, and a second bit signal associated with a second bit of the identification code. The computer processor transmits the first bit signal to a first light emitting device. The first bit signal results in the first light emitting device indicating the first bit signal as a first illuminated color.

12 Claims, 3 Drawing Sheets

IDENTIFICATION DISPLAY METHOD AND SYSTEM

FIELD OF THE INVENTION

The present invention relates to a method and associated system for using light emitting devices to display identification codes.

BACKGROUND OF THE INVENTION

Presenting data typically comprises an inefficient process with little flexibility. Accordingly, there exists a need in the art to overcome the deficiencies and limitations described herein above.

SUMMARY OF THE INVENTION

The present invention provides a message presentation method comprising: receiving, by a computer processor of an electrical device, first data associated with a first specified function of the electrical device, wherein the electrical device comprises a plurality of light emitting devices; generating, by the computer processor, a first identification code identifying the first specified function; generating, by the computer processor, a first bit signal at a first specified level, wherein the first bit signal is associated with a first bit of the first binary identification code; generating, by the computer processor, a second bit signal at a second specified level differing from the first specified level, wherein the second signal is associated with a second bit of the first identification code; and transmitting, by the computer processor, the first bit signal at the first specified level to a first light emitting device of the plurality of light emitting devices resulting in the first light emitting device indicating the first bit signal as a first illuminated color.

The present invention provides a computer program product, comprising a computer readable storage medium having a computer readable program code embodied therein, the computer readable program code comprising an algorithm that when executed by a computer processor of an electrical device implements a method comprising: receiving, by the computer processor, first data associated with a first specified function of the electrical device, wherein the electrical device comprises a plurality of light emitting devices; generating, by the computer processor, a first identification code identifying the first specified function; generating, by the computer processor, a first bit signal at a first specified level, wherein the first bit signal is associated with a first bit of the first binary identification code; generating, by the computer processor, a second bit signal at a second specified level differing from the first specified level, wherein the second signal is associated with a second bit of the first identification code; and transmitting, by the computer processor, the first bit signal at the first specified level to a first light emitting device of the plurality of light emitting devices resulting in the first light emitting device indicating the first bit signal as a first illuminated color.

The present invention provides an electrical device comprising a computer processor coupled to a computer-readable memory unit, the memory unit comprising instructions that when executed by the computer processor implements a method comprising: receiving, by the computer processor, first data associated with a first specified function of the electrical device, wherein the electrical device comprises a plurality of light emitting devices; generating, by the computer processor, a first identification code identifying the first specified function; generating, by the computer processor, a first bit signal at a first specified level, wherein the first bit signal is associated with a first bit of the first binary identification code; generating, by the computer processor, a second bit signal at a second specified level differing from the first specified level, wherein the second signal is associated with a second bit of the first identification code; and transmitting, by the computer processor, the first bit signal at the first specified level to a first light emitting device of the plurality of light emitting devices resulting in the first light emitting device indicating the first bit signal as a first illuminated color.

The present invention advantageously provides a simple method and associated system capable of presenting data.

DETAILED DESCRIPTION OF THE INVENTION

Figure 1:
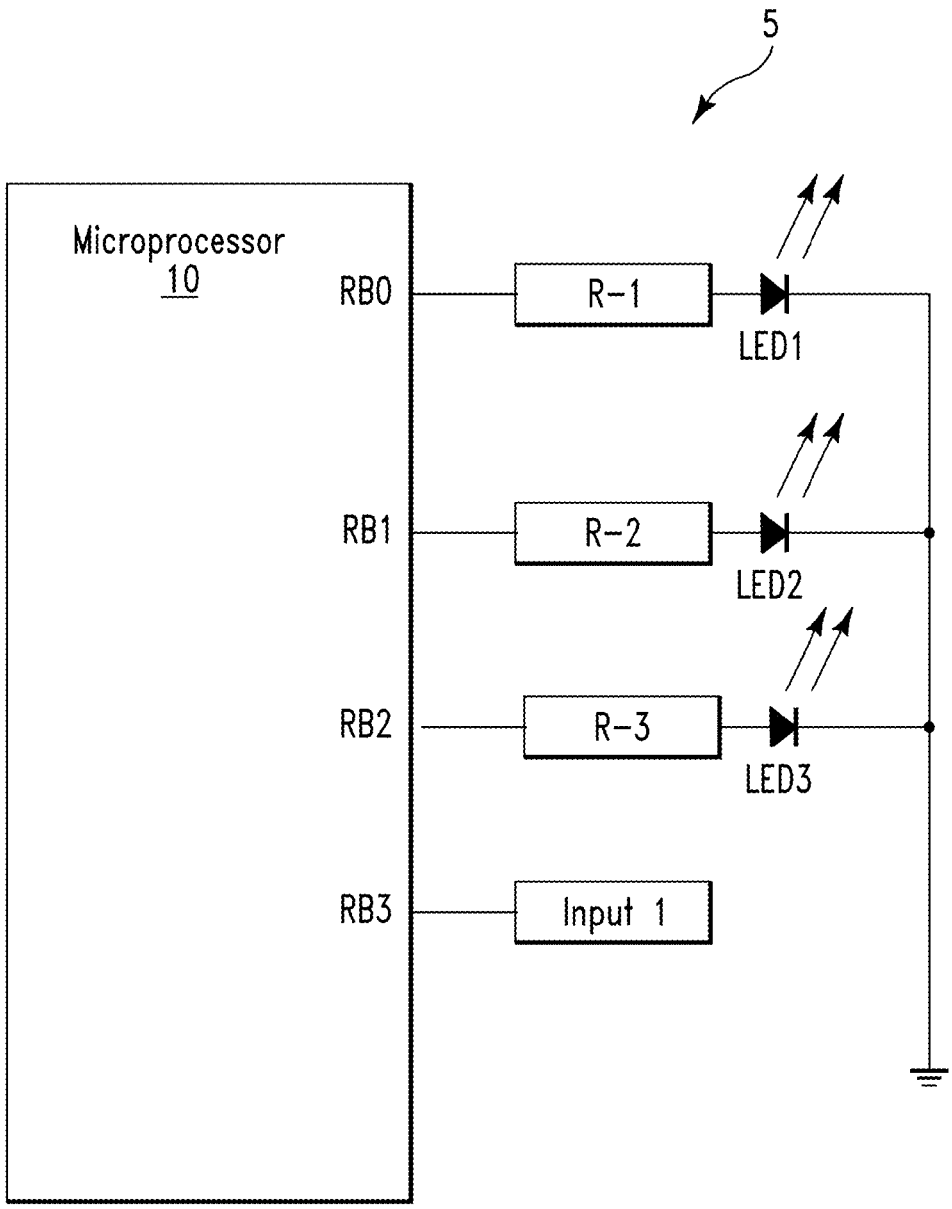
FIG. 1 illustrates an electrical device comprising light emitting devices to display identification codes, in accordance with embodiments of the present invention

FIG. 1 illustrates an electrical device 5 comprising light emitting devices to display identification codes, in accordance with embodiments of the present invention. The electrical device may include any type of electrical/mechanical device including, inter alia, a computer, a printer, a telephone, a television, an automobile, etc. The identification codes are associated with specified functions of the electrical device 5. For example, the identification codes may be associated with: error codes for a malfunctioning device (e.g., a printer error), a user identification code authorizing a user to access electrical device 5, etc. Light emitting devices may include any type of lighting device including, inter alia, light emitting diodes (e.g., LED1, LED 2, and LED3 as illustrated in FIG. 1), incandescent lamps, fluorescent lamps, ePaper, etc. LEDs may include any type of LEDs including RGB (red/green/blue) LEDs, organic light emitting diodes, etc. Additionally, system 5 may include any number of LEDs.

FIG. 1 illustrates an example comprising microprocessor 10 (e.g., an addressable RGB LED module) connected to LEDs: LED1, LED2, and LED3 through resistors: R1, R2, and R3. Microprocessor 10 may configure 1-128 addresses (comprised by identification codes) using RGB LEDs (LED1, LED2, and LED3) and an input signal. Using RGB LEDs allow for displaying various colors (e.g., red, green, blue, red+green, green+blue, blue+red, red+green+blue, etc) indicating various bits that represent identification codes for electrical device 5. Microprocessor 10 comprises four input/output terminals (RB0-RB3) used for generating 1-128 different identification codes. RB0-RB2 are configured to drive LED1-LED3. RB3 is configured to receive an input1 for receiving an analog signal (e.g., for measuring a voltage from sensors, for measuring an output voltage from a power supply, etc), a high (1) or low (0) signal (i.e., for setting up identification code sequences, display sequence, brightness, etc). Alternatively, RB3 may comprise multiple inputs (e.g., RB3-RB7) each receiving a binary input and/or an analog input to determine an overall health of system 5 and to enable a specified display code sequence with respect to LED1-

LED3. Therefore, electrical device 5 may be used to display up to 128 different sequences associated with 128 different identification codes. Each bit represents one color and therefore a user may view an initialized sequence by viewing a most significant bit (MSB) in an identification code and counting to a least significant bit (LSB).

As an alternative, pulse width modulation (i.e., as described with respect to FIG. 2, infra) may be used to display more than seven colors thereby expanding a displayed range of codes. Additionally, table 1 may be presented (i.e., electrical device 5) to a user for decoding the various sequences starting from left to right.

TABLE 1

| Condition | White | Magenta | Cyan | Yellow | Blue | Green | Red |
|---|---|---|---|---|---|---|---|
| No Error | Off | Off | Off | Off | Off | Off | Off |
| Paper Jam 1 | On | Off | Off | Off | Off | Off | On |
| Paper Jam 2 | On | Off | Off | Off | Off | On | Off |
| Paper Jam 3 | On | Off | Off | Off | Off | On | On |
| Paper Jam 4 | On | Off | Off | Off | On | Off | Off |
| Incorrect Paper size | On | Off | Off | Off | On | Off | On |
| Insufficient memory | Off | On | Off | Off | Off | Off | Off |
| Memory full | Off | On | Off | Off | Off | Off | On |
| Page too complex to print | Off | On | Off | Off | Off | On | Off |
| Font card not supported | Off | On | Off | Off | Off | On | On |
| Defective font card | Off | On | Off | Off | On | Off | Off |
| Transfer roll error | Off | Off | On | Off | Off | Off | Off |
| Fuser error 1 | Off | Off | On | Off | Off | Off | On |
| Fuser error 2 | Off | Off | On | Off | Off | On | Off |
| Fuser error 3 | Off | Off | On | Off | Off | On | On |
| Fuser error 4 | Off | Off | On | Off | On | Off | Off |
| Fan stalled | Off | Off | On | Off | On | Off | On |
| System board error 1 | Off | Off | Off | On | Off | Off | Off |
| System board error 2 | Off | Off | Off | On | Off | Off | On |
| System board error 3 | Off | Off | Off | On | Off | On | Off |
| System board error 4 | Off | Off | Off | On | Off | On | On |

For example (i.e., to display a range of 0-127) the following bits are represented by the following colors:

1. Bit 7 (MSB)=White (Red+Green+Blue)
2. Bit 6=Magenta (Blue+Red)
3. Bit 5=Cyan (Green+Blue)
4. Bit 4=Yellow (Red+Green)
5. Bit 3=Blue
6. Bit 2=Green
1. Bit 1 (LSB)=Red The following Binary IDs are represented by the following color and/or blank (i.e., disabled LEDs) LED sequences:

1. 0000000=blank-blank-blank-blank-blank-blank-blank
2. 0000001=blank-blank-blank-blank-blank-blank-Red
3. 0000010=blank-blank-blank-blank-blank-Green-blank
4. 0000011=blank-blank-blank-blank-blank-Green-Red
5. 0000100=blank-blank-blank-blank-Blue-blank-blank
6. 0001001=blank-blank-blank-Yellow (Red+Green)-blank-blank-Red
7. 0010010=blank-blank-Cyan (Green+Blue)-blank-blank-Green-blank
8. 0100001=blank-Magenta (Blue+Red)-blank-blank-blank-blank-Red
9. 1010110=White (R+G+B)-blank-Cyan (Green+Blue)-blank-Blue-Green-blank Therefore, as an example:

1. If there is a flashing blue/white (or white/blue) LED, an ID may be identified as 1000100 (44 h).
2. If there is a flashing green LED, an ID may be identified as 0000010 (02 h).
3. If a series of blue-magenta-yellow (LEDs) are detected, an ID may be identified as 0101100 (2Ch), because blue is bit 3, magenta is bit 6, and yellow is bit 4.

Table 1 describes an implementation example for displaying (by setting an output level of I/O terminals RB0-RB3 to a binary high or low) seven different colors in various on/off (i.e., binary high and low signals) sequences (i.e., left to right) in order to indicate various error conditions for a laser printer.

Table 1 associates different types of printer errors with different color and on/off sequences. In the example associated with table 1, a single RGB LED may be mounted on a circuit board. During normal operation (i.e., a no error condition for the laser printer), the single RGB LED will remain in an off condition. When error condition is detected, firmware in a processor (e.g., microprocessor 10) will control output pins (e.g., RB0-RB2) to display a sequence of different colors to indicate a corresponding error code. A full range (7-bits) may be used to display total of 127 error conditions (plus a no error condition). Additionally, error conditions may be grouped. For example (from table 1):

1. When a white color is displayed in any sequence, this may indicate a paper jam related condition (e.g., paper jam 1-paper jam 4).
2. When a magenta color is displayed in any sequence, this may indicate a software related issue.
3. When a cyan color is displayed in any sequence, this may indicate a fuser related issue.
4. When a yellow color is displayed in any sequence, this may indicate a system board related problem (e.g., system board error 1-system board error 4).
5. When red, white, and blue colors are displayed in any sequence (e.g., red, white, blue; white, red, blue; blue, white, red; etc) this may indicate an incorrect paper size.

Additionally, microprocessor 10 may be capable of generating a pulse width modulation signal for driving LEDs: LED1-LED3 through (current limiting) resistors: R-1-R-3. Microprocessor 10 generates a pulse width modulation signal that varies in signal strength therefore causing LEDs: LED1-LED3 to illuminate in various colors associated with various bits of an identification code for electrical device 5.

Figure 2:
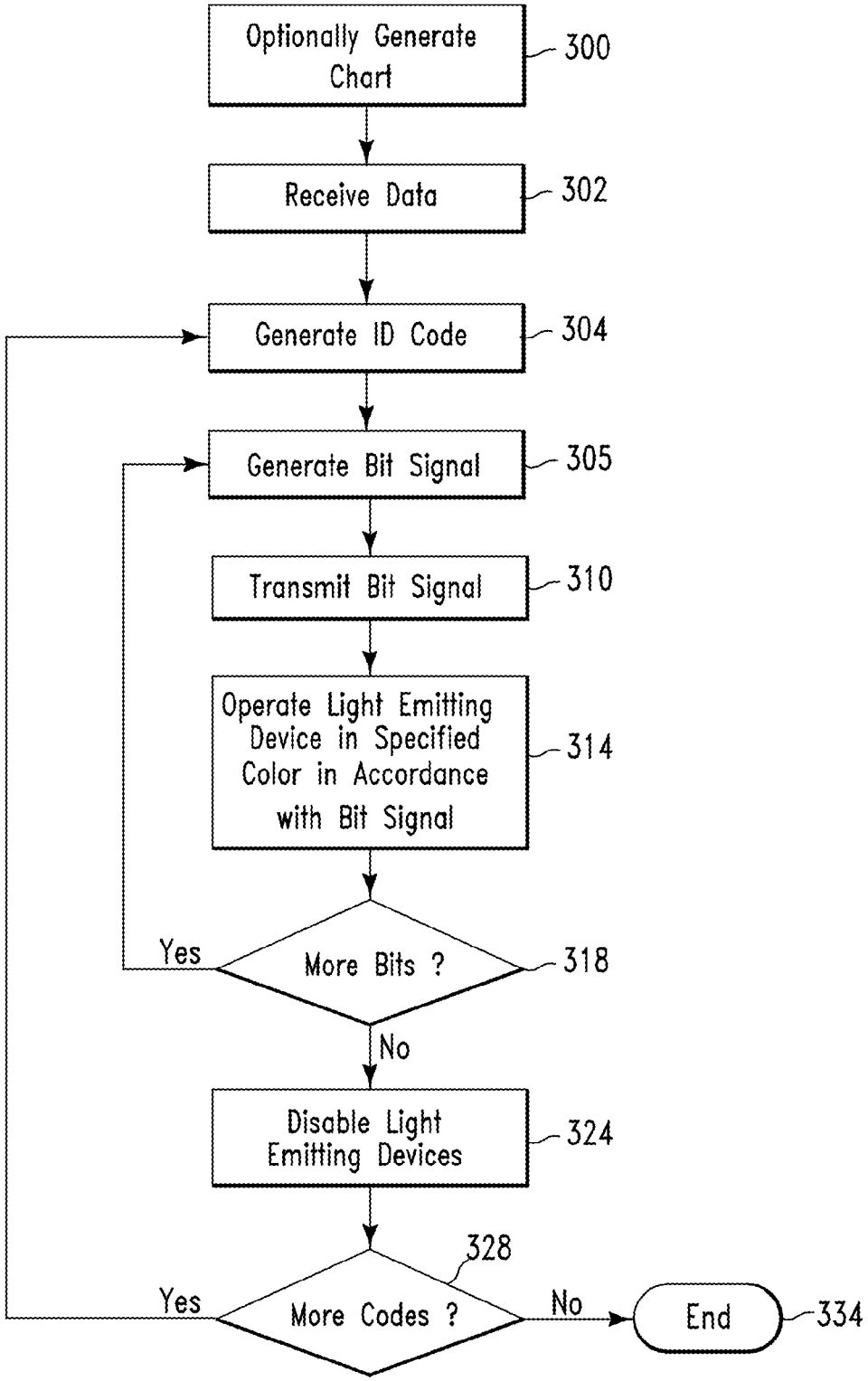
FIG. 2 illustrates an algorithm used by the system of FIG. 1 for using light emitting devices to display identification codes associated with messages, in accordance with embodiments of the present invention.

FIG. 2 illustrates an algorithm used by system 5 of FIG. 1 for or using light emitting devices to display identification codes associated with messages, in accordance with embodiments of the present invention. In step 300, a computer processor of an electrical device (e.g., electrical device 5 of FIG.

1) optionally generates (and presents to user) a decoding chart (e.g., the chart of table 1) for decoding codes associated with a specified function (e.g., an error condition or malfunction, an access identification process, etc) of the electrical device. In step 302, the computer processor receives data associated with the specified function (e.g., an error condition or malfunction, an access identification process, etc) of the electrical device. In step 304, the computer processor generates an identification code (e.g., a binary code) identifying the specified function of the electrical device. In step 305, the computer processor generates a bit signal at a specified level (e.g., a binary signal 1 or 0 signal to generate a combination of colors) or a pulse width modulated signal (to generate a combination and brightness of colors) in order to enable LED1-LED3 (and any additional LEDS not illustrated in FIG. 1) to illuminate a combination of colors and/or brightness levels. The bit signal is (or pulse width modulated signal) is associated with a bit of the identification code. In step 310, the computer processor transmits the bit signal (or pulse width modulated signal) to one of the light emitting devices. In step 314 (in response to the transmitted bit signal) the light emitting device is operated in an off position (if a binary zero bit is transmitted) or an on (illuminated) position (if a binary one bit or pulse width modulated signal is transmitted) in a specified color (and/or brightness level). The illuminated specified color is independent from any specific position of bits of the identification code. In step 318, the computer processor determines if anymore bit signals and/or pulse width modulated signals are required to indicate the identification code. If in step 318, the computer processor determines that more bit signals are required to indicate the identification code then step 304 is repeated until all required bit signals (at specified levels) are generated, transmitted, and the light emitting devices are operated. In response, the light emitting device(s) indicate all associated bit (or PWM) signals thereby representing a message (i.e., for a user such as, inter alia, a technician, etc) associated with the identification code identifying the specified function. If in step 318, the computer processor determines that no more bit signals are required to indicate the binary identification code then in step 324, the LED(s) are disabled (e.g., after a specified time period). In step 328, it is determined if anymore codes (e.g., an error condition or malfunction, an access identification process, etc) have been detected (i.e., for the electrical device). If in step 328, it is determined that more specified code (e.g., an error condition or malfunction, an access identification process, etc) have been detected then steps 304-328 are repeated to present messages associated with identification codes. If in step 328, it is determined that no more specified codes (e.g., an error condition or malfunction, an access identification process, etc) have been detected then in step 334, the process is terminated.

As a first example for performing steps 300-334, a pulse width modulated signal(s) is used to generate the bit signals (i.e., as illustrated with respect to FIG. 2). The pulse width modulated signal(s) enables a single (or multiple) LED (e.g., an RGB LED) to present or display the identification code. For example, a first bit signal may be transmitted to the single LED at a first level (or duty cycle) that causes the single LED to indicate the first bit signal as a first illuminated color (and/or first specified brightness level). After the first bit signal has been transmitted to the single LED, a second bit signal may be transmitted to the single LED at a second level (or duty cycle) that causes the single LED to indicate the second bit signal as a second illuminated color (and/or second specified brightness level). The first illuminated color (and/or first specified brightness level) differs from the second illuminated color (and/or second specified brightness level). The single light emitting device indicating the first bit signal as the first illuminated color (and/or first specified brightness level) in combination with the single light emitting device indicating the second bit signal as the second illuminated color (and/or second specified brightness level) represent a message associated with the identification code identifying the specified function. This process may include multiple bits signals causing the single LED to indicate the multiple bit signals as multiple different illuminated colors (and/or specified brightness levels).

As a second example for performing steps 300-334, a digital or binary (high or low) signal(s) is used to generate the bit signals (i.e., as illustrated with respect to FIG. 1). The digital signals enable multiple LEDs to present or display the identification code. For example, a first bit signal may be transmitted to a first LED that causes the first LED to indicate the first bit signal as a first illuminated color (and/or first specified brightness level). After the first bit signal has been transmitted to the first LED, a second bit signal may be transmitted to a second LED that causes the second LED to indicate the second bit signal as a second illuminated color (and/or second specified brightness level). The first illuminated color (and/or first specified brightness level) differs from the second illuminated color (and/or second specified brightness level). The first light emitting device indicating the first bit signal as the first illuminated color (and/or first specified brightness level) in combination with the second light emitting device indicating the second bit signal as the second illuminated color (and/or second specified brightness level) represent a message associated with the identification code identifying the specified function. This process may include multiple bits signals causing the multiple LEDs to indicate the multiple bit signals as multiple different illuminated colors (and/or specified brightness levels).

Figure 3:
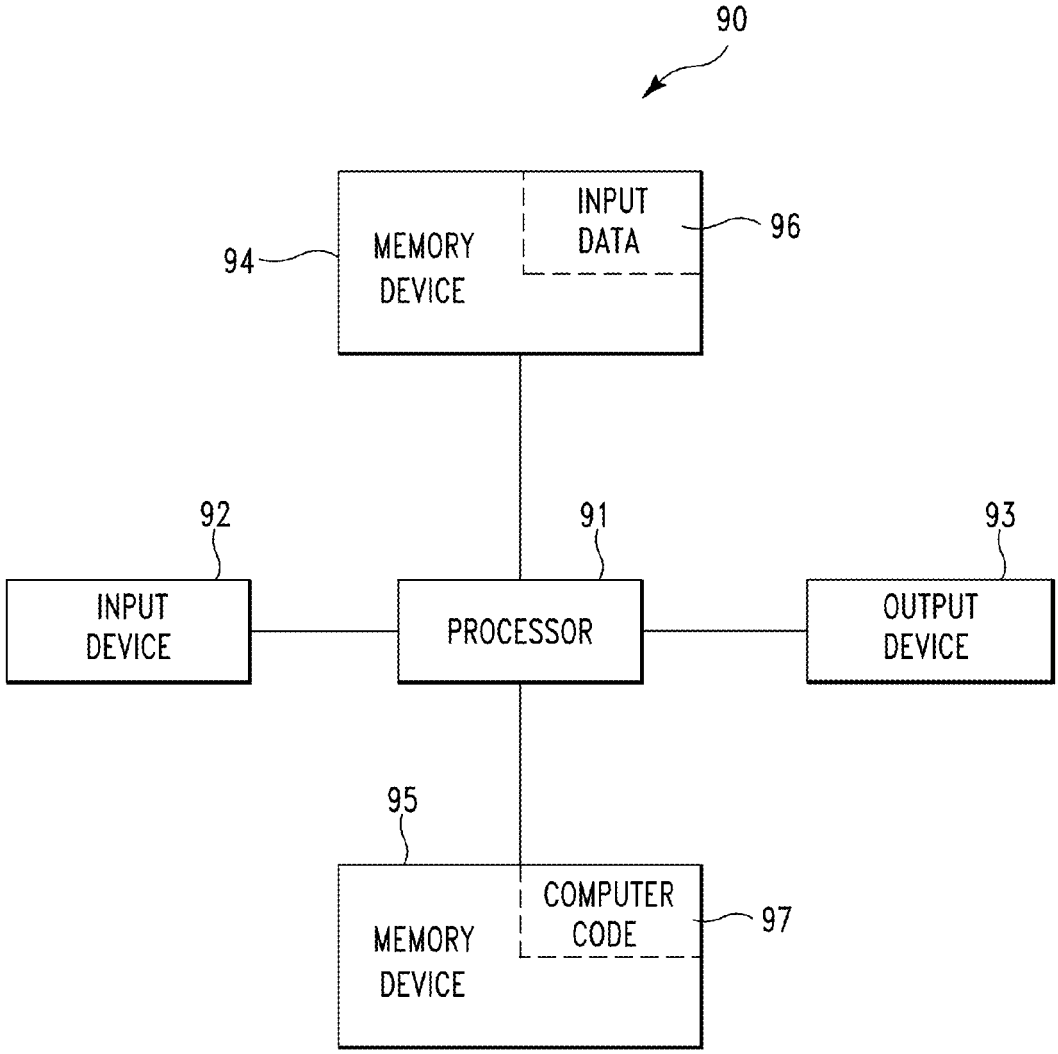
FIG. 3 illustrates a computer apparatus used for enabling light emitting devices to display identification codes, in accordance with embodiments of the present invention.

FIG. 3 illustrates a computer apparatus 90 (e.g., electrical device 10 of FIG. 1) used for enabling light emitting devices to display identification codes, in accordance with embodiments of the present invention. The computer system 90 comprises a processor 91, an input device 92 coupled to the processor 91, an output device 93 coupled to the processor 91, and memory devices 94 and 95 each coupled to the processor 91. The input device 92 may be, inter alia, sensors, signals from additional subsystems (e.g., a power supply), a keyboard, a software application, a mouse, etc. The output device 93 may be, inter alia, light emitting devices, a printer, a plotter, a computer screen, a magnetic tape, a removable hard disk, a floppy disk, a software application, etc. The memory devices 94 and 95 may be, inter alia, a hard disk, a floppy disk, a magnetic tape, an optical storage such as a compact disc (CD) or a digital video disc (DVD), a dynamic random access memory (DRAM), a read-only memory (ROM), etc. The memory device 95 includes a computer code 97. The computer code 97 includes algorithms (e.g., the algorithm of FIG. 3) for enabling light emitting devices to display identification codes. The processor 91 executes the computer code 97. The memory device 94 includes input data 96. The input data 96 includes input required by the computer code 97. The output device 93 displays output from the computer code 97. Either or both memory devices 94 and 95 (or one or more additional memory devices not shown in FIG. 3) may comprise the algorithm of FIG. 2 and may be used as a computer usable medium (or a computer readable medium or a program storage device) having a computer readable program code embodied therein and/or having other data stored therein, wherein the computer readable program code comprises the computer code 97. Generally, a computer program product (or, alternatively, an article of manufacture) of the computer system 90 may comprise the computer usable medium (or said program storage device).

Still yet, any of the components of the present invention could be created, integrated, hosted, maintained, deployed, managed, serviced, etc. by a service provider who offers to enable light emitting devices to display identification codes. Thus the present invention discloses a process for deploying, creating, integrating, hosting, maintaining, and/or integrating computing infrastructure, comprising integrating computer-readable code into the computer system 90, wherein the code in combination with the computer system 90 is capable of performing a method for enabling light emitting devices to display identification codes. In another embodiment, the invention provides a method that performs the process steps of the invention on a subscription, advertising, and/or fee basis. That is, a service provider, such as a Solution Integrator, could offer to enable light emitting devices to display identification codes. In this case, the service provider can create, maintain, support, etc. a computer infrastructure that performs the process steps of the invention for one or more customers. In return, the service provider can receive payment from the customer(s) under a subscription and/or fee agreement and/or the service provider can receive payment from the sale of advertising content to one or more third parties.

While FIG. 3 shows the computer system 90 as a particular configuration of hardware and software, any configuration of hardware and software, as would be known to a person of ordinary skill in the art, may be utilized for the purposes stated supra in conjunction with the particular computer system 90 of FIG. 3. For example, the memory devices 94 and 95 may be portions of a single memory device rather than separate memory devices.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

The invention claimed is:

1. A message presentation method comprising:

receiving, by a computer processor of an electrical device, first data associated with a first specified function of said electrical device, wherein said first data comprises a binary input and an analog input configured to determine an overall health of said electrical device and enable a specified display code sequence, and wherein said electrical device comprises a plurality of light emitting devices;

generating, by said computer processor based on said binary input and said analog input, a first identification code identifying said first specified function;

generating, by said computer processor, a first bit signal at a first specified level, wherein said first bit signal is associated with a first bit of said first identification code, and wherein said first bit signal comprises a binary signal;

generating, by said computer processor, a second bit signal at a second specified level differing from said first specified level, wherein said second bit signal is associated with a second bit of said first identification code, and wherein said second bit signal comprises a pulse width modulated signal;

generating, by said computer processor, an additional bit signal at an additional specified level differing from said first specified level and said second specified level, wherein said additional bit signal is associated with an additional bit of said first identification code;

generating, by said computer processor, a decoding chart indicating said first specified function associated with said first identification code indicating said first bit signal as said first illuminated color, wherein said chart further indicates said second bit signal as a second illuminated color differing from said first illuminated color, wherein said chart further indicates said additional bit signal as flashing between multiple illuminated colors differing from said first illuminated color and said second illuminated color, and wherein said chart comprises a condition column indicating various conditions and multiple LED color columns indicating LED colors and associated binary high or low signal indications associated with each color of said LED colors;

presenting, by said computer processor to a user of said electrical device, said decoding chart;

transmitting, by said computer processor, said first bit signal at said first specified level to a first light emitting device of said plurality of light emitting devices resulting in said first light emitting device indicating said first bit signal as said first illuminated color, wherein said first illuminated color is independent from any specific position of bits of said first identification code;

transmitting, by said computer processor, said additional bit signal at said additional specified level to an additional light emitting device of said plurality of light emitting devices resulting in said additional light emitting device indicating said additional bit signal as said flashing between multiple illuminated colors; and transmitting, by said computer processor, said second bit signal at said second specified level to a second light emitting device of said plurality of light emitting devices resulting in said second light emitting device indicating said second bit signal as said second illuminated color differing from said first illuminated color, wherein said first light emitting device indicating said first bit signal as said first illuminated color in combination with said second light emitting device indicating said second bit signal as said second illuminated color and said additional light emitting device indicating said additional bit signal as said flashing between multiple illuminated colors represent a first message associated with said first identification code identifying said first specified function, wherein said first bit signal results in said first light emitting device emitting said first illuminated color comprising a first specified brightness level associated with said first specified level, wherein said additional bit signal results in said additional light emitting device emitting said flashing between multiple illuminated colors comprising an additional specified brightness level associated with said additional specified level, wherein said second bit signal results in said second light emitting device emitting said second illuminated color comprising a second specified brightness level associated with said second specified level, wherein said first specified brightness level differs from said second specified brightness level, and wherein said first illuminated color comprising said first specified brightness level in combination with said second light emitting device emitting said second illuminated color comprising said second specified brightness level represent said first message.

2. The method of claim 1, wherein said first message indicates an error message specifying a specific malfunction of said electrical device.

3. The method of claim 1, further comprising:

generating, by said computer processor, a third bit signal at a third specified level, wherein said third bit signal is associated with a third bit of said first binary identification code; and transmitting, by said computer processor, said third bit signal at said third specified level to a third light emitting device of said plurality of light emitting devices resulting in said third light emitting device indicating said third bit signal, wherein said first light emitting device indicating said first bit signal in combination with said second light emitting device indicating said second bit signal and said third light emitting device indicating said third bit signal represent a second message associated with said first identification code identifying said first specified function.

4. The method of claim 3, wherein said first bit signal comprises a binary high signal resulting in said first light emitting device emitting a first light in a first color, wherein said third bit signal comprises a binary high signal resulting in said third light emitting device emitting a third light in a third color differing from said first color, and wherein said first light in said first color in combination with said third light in said second color represent said second message.

5. The method of claim 3, wherein said first bit signal comprises a binary high signal resulting in said first light emitting device emitting a first light in a first color, wherein said third bit signal comprises a binary low signal resulting in disabling said third light emitting device, and wherein said first light in said first color in combination with said third light emitting device being disabled represent said second message.

6. The method of claim 3, wherein said first bit signal results in said first light emitting device emitting a first light comprising a specified brightness level associated with said first specified level, wherein said third bit signal results in said third light emitting device emitting a third light comprising an additional specified brightness level associated with said second specified level, wherein said specified brightness level differs from said additional specified brightness level, and wherein said first light comprising said first specified brightness level in combination with said third light emitting device emitting said third light comprising said additional specified brightness level represent said second message.

7. The method of claim 1, wherein said plurality of light emitting devices comprise devices selected from the group consisting of light emitting diodes and ePaper.

8. The method of claim 7, wherein said light emitting diodes comprise devices selected from the group consisting of RGB light emitting diodes and organic light emitting diodes.

9. The method of claim 1, further comprising:

providing at least one support service for at least one of creating, integrating, hosting, maintaining, and deploying computer-readable code in said computing system, wherein the code in combination with the computing system is capable of performing: said receiving, said generating said first identification code, said generating said first bit signal, said generating said second bit signal, and said transmitting said first bit signal.

10. A computer program product, comprising a computer readable hardware storage device storing a computer readable program code, said computer readable program code comprising an algorithm that when executed by a computer processor of an electrical device implements a method comprising:

receiving, by said computer processor, first data associated with a first specified function of said electrical device, wherein said first data comprises a binary input and an analog input configured to determine an overall health of said electrical device and enable a specified display code sequence, and wherein said electrical device comprises a plurality of light emitting devices;

generating, by said computer processor based on said binary input and said analog input, a first identification code identifying said first specified function;

generating, by said computer processor, a first bit signal at a first specified level, wherein said first bit signal is associated with a first bit of said first identification code, and wherein said first bit signal comprises a binary signal;

generating, by said computer processor, a second bit signal at a second specified level differing from said first specified level, wherein said second bit signal is associated with a second bit of said first identification code, and wherein said second bit signal comprises a pulse width modulated signal;

generating, by said computer processor, an additional bit signal at an additional specified level differing from said first specified level and said second specified level, wherein said additional bit signal is associated with an additional bit of said first identification code;

generating, by said computer processor, a decoding chart indicating said first specified function associated with said first identification code indicating said first bit signal as said first illuminated color, wherein said chart further indicates said second bit signal as a second illuminated color differing from said first illuminated color, wherein said chart further indicates said additional bit signal as flashing between multiple illuminated colors differing from said first illuminated color and said second illuminated color, and wherein said chart comprises a condition column indicating various conditions and multiple LED color columns indicating LED colors and associated binary high or low signal indications associated with each color of said LED colors;

presenting, by said computer processor to a user of said electrical device, said decoding chart;

transmitting, by said computer processor, said first bit signal at said first specified level to a first light emitting device of said plurality of light emitting devices resulting in said first light emitting device indicating said first bit signal as said first illuminated color, wherein said first illuminated color is independent from any specific position of bits of said first identification code;

transmitting, by said computer processor, said additional bit signal at said additional specified level to an additional light emitting device of said plurality of light emitting devices resulting in said additional light emitting device indicating said additional bit signal as said flashing between multiple illuminated colors; and transmitting, by said computer processor, said second bit signal at said second specified level to a second light emitting device of said plurality of light emitting devices resulting in said second light emitting device indicating said second bit signal as said second illuminated color differing from said first illuminated color, wherein said first light emitting device indicating said first bit signal as said first illuminated color in combination with said second light emitting device indicating said second bit signal as said second illuminated color and said additional light emitting device indicating said additional bit signal as said flashing between multiple illuminated colors represent a first message associated with said first identification code identifying said first specified function, wherein said first bit signal results in said first light emitting device emitting said first illuminated color comprising a first specified brightness level associated with said first specified level, wherein said additional bit signal results in said additional light emitting device emitting said flashing between multiple illuminated colors comprising an additional specified brightness level associated with said additional specified level, wherein said second bit signal results in said second light emitting device emitting said second illuminated color comprising a second specified brightness level associated with said second specified level, wherein said first specified brightness level differs from said second specified brightness level, and wherein said first illuminated color comprising said first specified brightness level in combination with said second light emitting device emitting said second illuminated color comprising said second specified brightness level represent said first message.

11. The computer program product of claim 10, wherein said first message indicates an error message specifying a specific malfunction of said electrical device.

12. An electrical device comprising a computer processor coupled to a computer-readable memory unit, said memory unit comprising instructions that when executed by the computer processor implements a method comprising:

receiving, by said computer processor, first data associated with a first specified function of said electrical device, wherein said first data comprises a binary input and an analog input configured to determine an overall health of said electrical device and enable a specified display code sequence, and wherein said electrical device comprises a plurality of light emitting devices;

generating, by said computer processor based on said binary input and said analog input, a first identification code identifying said first specified function;

generating, by said computer processor, a first bit signal at a first specified level, wherein said first bit signal is associated with a first bit of said first identification code, and wherein said first bit signal comprises a binary signal;

generating, by said computer processor, a second bit signal at a second specified level differing from said first specified level, wherein said second bit signal is associated with a second bit of said first identification code, and wherein said second bit signal comprises a pulse width modulated signal;

generating, by said computer processor, an additional bit signal at an additional specified level differing from said first specified level and said second specified level, wherein said additional bit signal is associated with an additional bit of said first identification code;

generating, by said computer processor, a decoding chart indicating said first specified function associated with said first identification code indicating said first bit signal as said first illuminated color, wherein said chart further indicates said second bit signal as a second illuminated color differing from said first illuminated color, wherein said chart further indicates said additional bit signal as flashing between multiple illuminated colors differing from said first illuminated color and said second illuminated color, and wherein said chart comprises a condition column indicating various conditions and multiple LED color columns indicating LED colors and associated binary high or low signal indications associated with each color of said LED colors;

presenting, by said computer processor to a user of said electrical device, said decoding chart;

transmitting, by said computer processor, said first bit signal at said first specified level to a first light emitting device of said plurality of light emitting devices resulting in said first light emitting device indicating said first bit signal as said first illuminated color, wherein said first illuminated color is independent from any specific position of bits of said first identification code;

transmitting, by said computer processor, said additional bit signal at said additional specified level to an additional light emitting device of said plurality of light emitting devices resulting in said additional light emitting device indicating said additional bit signal as said flashing between multiple illuminated colors; and transmitting, by said computer processor, said second bit signal at said second specified level to a second light emitting device of said plurality of light emitting devices resulting in said second light emitting device indicating said second bit signal as said second illuminated color differing from said first illuminated color, wherein said first light emitting device indicating said first bit signal as said first illuminated color in combination with said second light emitting device indicating said second bit signal as said second illuminated color and said additional light emitting device indicating said additional bit signal as said flashing between multiple illuminated colors represent a first message associated with said first identification code identifying said first specified function, wherein said first bit signal results in said first light emitting device emitting said first illuminated color comprising a first specified brightness level associated with said first specified level, wherein said additional bit signal results in said additional light emitting device emitting said flashing between multiple illuminated colors comprising an additional specified brightness level associated with said additional specified level, wherein said second bit signal results in said second light emitting device emitting said second illuminated color comprising a second specified brightness level associated with said second specified level, wherein said first specified brightness level differs from said second specified brightness level, and wherein said first illuminated color comprising said first specified brightness level in combination with said second light emitting device emitting said second illuminated color comprising said second specified brightness level represent said first message.

* * * * *